US005739734A

United States Patent [19]

Chen et al.

[11] Patent Number: 5,739,734

[45] Date of Patent: Apr. 14, 1998

[54] EVANESCENT MODE BAND REJECT FILTERS AND RELATED METHODS

[75] Inventors: Ming Hui Chen; Song Mu Yang, both of Taipei, China

[73] Assignee: Victory Industrial Corporation, China

[21] Appl. No.: 782,112

[22] Filed: Jan. 13, 1997

[51] Int. Cl.[6] ..... H01P 1/219; H01P 11/00

[52] U.S. Cl. ..... 333/210; 333/209; 333/249; 29/600

[58] Field of Search ..... 333/208, 1, 212, 333/227, 228, 231, 239, 248, 249, 250, 253; 29/600

[56] References Cited

U.S. PATENT DOCUMENTS

| | | | |
|---|---|---|---|
| 2,914,741 | 11/1959 | Unger | 333/249 |
| 3,058,072 | 10/1962 | Rizzi et al. | 333/73 |
| 3,634,788 | 1/1972 | Craven | 333/73 |
| 4,020,875 | 5/1977 | Akiba | 333/239 X |
| 4,291,287 | 9/1981 | Young et al. | 333/210 |
| 4,746,883 | 5/1988 | Sauvage et al. | 333/202 |
| 4,757,289 | 7/1988 | Kosugi et al. | 333/209 |
| 5,220,300 | 6/1993 | Snyder | 333/210 |
| 5,576,670 | 11/1996 | Suzuki et al. | 333/208 X |

*Primary Examiner*—Robert Pascal
*Assistant Examiner*—Senngsook Ham
*Attorney, Agent, or Firm*—Townsend and Townsend and Crew LLP

[57] ABSTRACT

Apparatus and related methods for an easily manufactured evanescent mode band reject filter that provides high performance with minimal dependence on critical dimensions. According to one embodiment, the present invention provides a band reject filter including a waveguide having an input, an output, a first wall between the input and the output, and a second wall opposite the first wall. The first wall is part of a substantially solid first block, and the second wall is part of a substantially solid second block. The waveguide is capable of transmitting an electromagnetic radiation signal from the input to the output, where the signal is at an operating frequency above a waveguide cutoff frequency. The band reject filter also includes at least one cavity coupled directly to the first wall of the waveguide, where the cavity is a substantially cylindrical cavity formed in the first block. Further, the cavity operates in an evanescent mode such that the cavity has a cavity cutoff frequency above the stopband frequency of the band reject filter. The cavity may have a circular, elliptical, or substantially rectangular cross-section in some specific embodiments.

31 Claims, 5 Drawing Sheets

EVANESCENT MODE BAND REJECT FILTERS AND RELATED METHODS

BACKGROUND OF THE INVENTION

The present invention relates to microwave transmission systems. More specifically, the present invention relates to evanescent mode band reject filters suitable for use in microwave (or millimeter-wave) transmission systems. Embodiments of the present invention are particularly useful for providing easily manufactured, good performance band reject filters utilizing evanescent mode cavities.

Band reject filters are commonly used in microwave transmission systems to minimize or attenuate propagation of a certain band of frequencies within a stopband bandwidth starting from a stopband frequency. The conventional method of designing such a band reject filter involves coupling a waveguide to a series of cavities, where these cavities are coupled to the waveguide via coupling apertures. In order to operate properly, these filters require cavities having a depth that is approximately a half-wavelength of the stopband frequency of the band reject filter. These cavities operate in a propagating mode, i.e., the cutoff frequency of the cavities is below the stopband frequencies of the filter. Conventional propagation mode band reject filters are thus designed using a waveguide coupled via apertures to cavities which operate in a normal propagating mode.

With such conventional propagation mode band reject filters, performance characteristics depend critically on specific dimensions. Specifically, a multitude of critical dimensions limit the performance in such filters. For example, the stopband bandwidth is controlled by the aperture dimensions in these filters having a waveguide with a wall having apertures coupled to cavities. In addition, the stopband frequency is controlled by the cavity depth, which must be about a half-wavelength long. Further, low voltage standing wave ratio (VSWR) at the passband is controlled by the spacing between cavities. These critical dimensions in the filter, and in particular aperture dimensions (such as slots having curved and/or straight edges in the wall of the waveguide), are often difficult to manufacture in order to provide reliable devices. The dependence of performance on these many critical dimensions reduces the device manufacturability of conventional propagation mode band reject filters.

From the above, it is seen that an easy-to-manufacture and high performance band reject filter with minimized dependence on multiple critical dimensions is desirable.

SUMMARY OF THE INVENTION

The present invention provides an apparatus and methods for an easily manufactured evanescent mode band reject filter that provides high performance with minimal dependence on critical dimensions.

According to one embodiment, the present invention provides a band reject filter including a waveguide having an input, an output, a first wall between the input and the output, and a second wall opposite the first wall. The first wall is pan of a substantially solid first block, and the second wall is part of a substantially solid second block. The waveguide is capable of transmitting an electromagnetic radiation signal, such as a microwave or millimeter-wave signal in specific embodiments, from the input to the output, where the signal is at an operating frequency above a waveguide cutoff frequency. The band reject filter also includes at least one cavity coupled directly to the first wall of the waveguide, where the cavity is a substantially cylindrical cavity formed in the first block. Further, the cavity operates in an evanescent mode such that the cavity has a cavity cutoff frequency above the stopband (or rejection band) frequency of the band reject filter. The cavity may have a circular, elliptical, or substantially rectangular cross-section in some specific embodiments.

According to another embodiment, the present invention provides a method of making an evanescent mode band reject filter that includes a waveguide coupled to multiple cutoff cavities. The method includes the step of providing a first block having a first surface forming a first wall of a waveguide. The first block includes multiple cutoff cavities formed therein from the first surface, and the multiple cutoff cavities are directly coupled to the waveguide. The method also includes the step of providing a second block having a second surface, a third surface and a fourth surface. The second surface forms a second wall of the waveguide, where the second wall is to be opposite to the first wall of the waveguide. The third and fourth surfaces form opposite side walls of the waveguide, where the side walls are to be perpendicular to the first and second walls of the waveguide. Further, the method includes the step of connecting the first block and the second block together such that the second surface and the first surface face each other to form the waveguide. In some embodiments, the method further includes a step of providing multiple holes through the second wall of the waveguide, where multiple stub tuners are to be disposed through the multiple holes and each of the cutoff cavities is to be substantially opposite a corresponding one of the stub tuners.

These and other embodiments of the present invention, as well as its advantages and features are described in more detail in conjunction with the text below and attached figures.

BRIEF DESCRIPTION OF THE DRAWINGS

FIG. 1(*b*) shows a top perspective view of the upper part and the lower part of the unassembled evanescent mode band reject filter of FIG. 1(*a*);

FIG. 2(*b*) is a top perspective view of the upper part and the lower part of the unassembled curved evanescent mode band reject filter of FIG. 2(*a*);

DESCRIPTION OF THE SPECIFIC EMBODIMENTS

The present invention provides an evanescent mode band reject filter designed using a waveguide coupled directly to cavities operating in the evanescent mode. In evanescent mode band reject filters according to the present invention, cutoff cavities (i.e., cavities having cutoff frequencies above the stopband frequencies of the band reject filters) are used, in contrast to normal propagating mode cavities which are used in conventional band reject filters. Unlike the conventional propagating mode band reject filters' apertures or slots, which often are shaped such that device manufacturability undesirably becomes an issue of device performance, the present invention eliminates slots and has cavities directly coupled to the waveguide without use of any strangely-shaped apertures or slots in the wall of the waveguide adjacent to the cavities. Further, with the present invention, the location of the stopband is controlled only by the diameter of the cavities, and the depth of the cavity is not critical. In some embodiments, tuning elements such as tuning stubs can be utilized for further improvement in filter performance. With the present invention, the number of dimensions critical to performance is reduced, improving manufacturability and allowing improved filter response, as discussed further below.

Figure 1A:
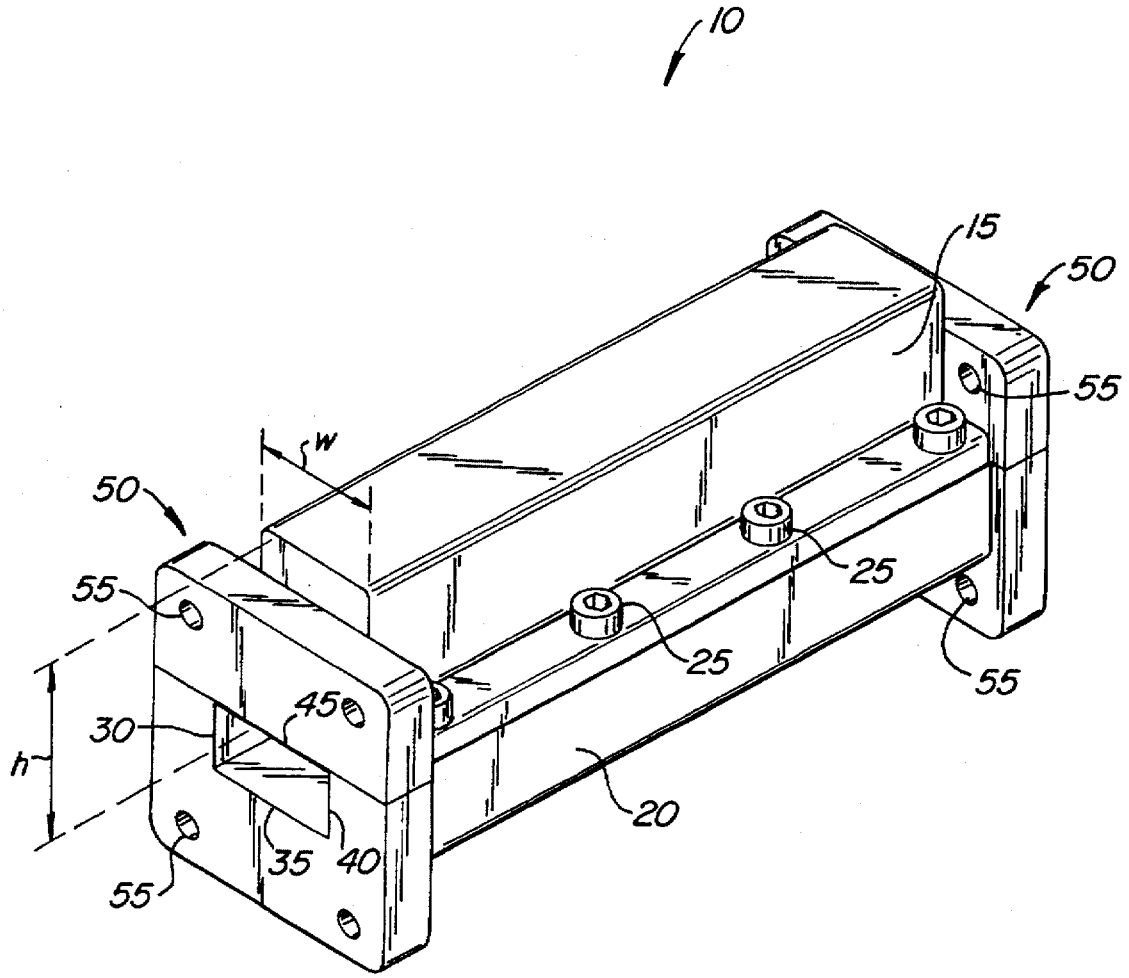
FIG. 1(*a*) is an exterior perspective view of an assembled evanescent mode band reject filter, according to a specific embodiment of the present invention.
Figure 1B:
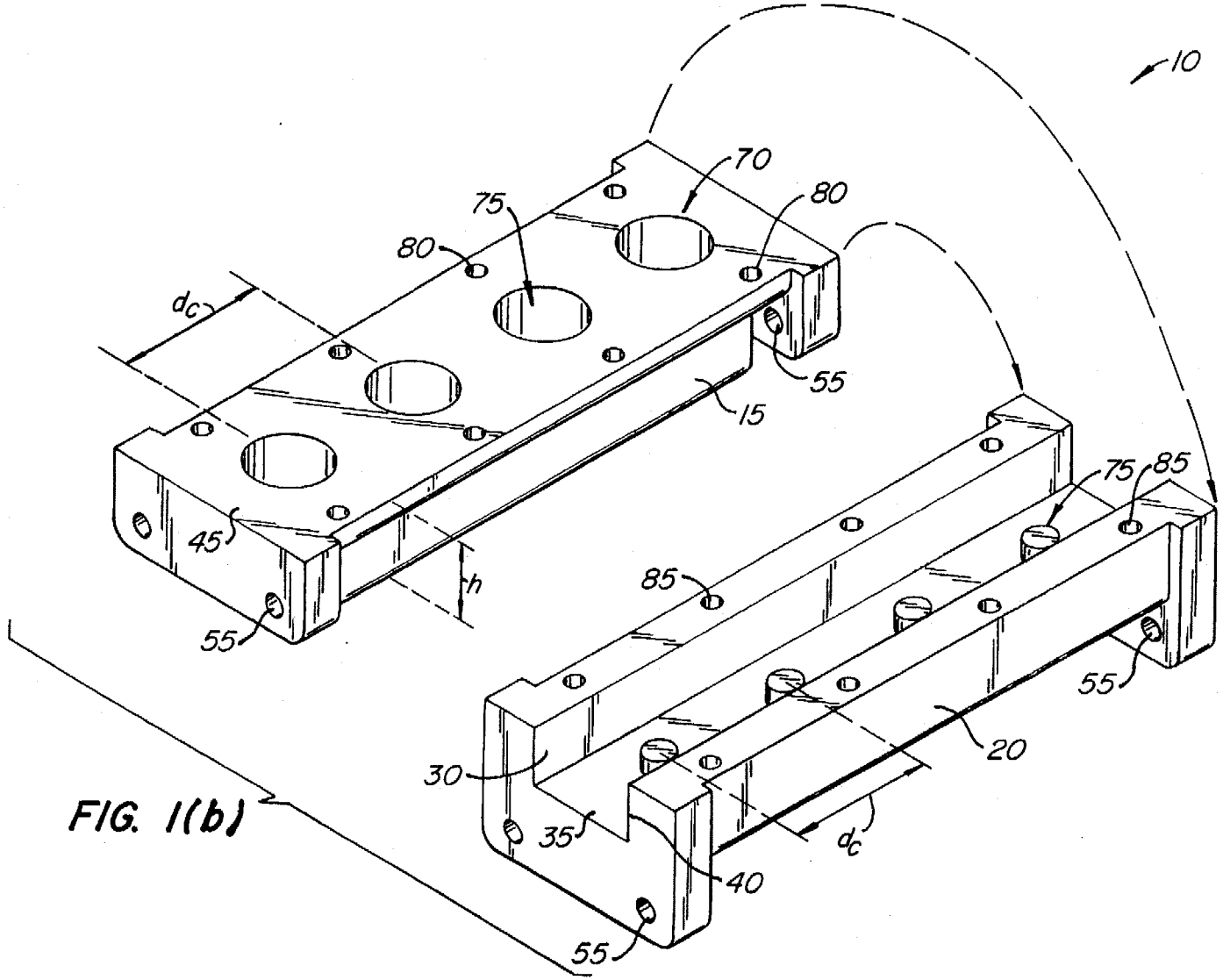

FIG. 1(*a*) is an exterior perspective view of an assembled evanescent mode band reject filter 10, according to a specific embodiment of the present invention. As seen in FIG. 1(*a*), assembled evanescent mode band reject filter 10 includes an upper part 15 and a lower part 20, which may be secured to each other by fasteners 25 such as screws (or bolts) going through holes (not seen in FIG. 1(*a*)) disposed through upper part 15 and lower part 20. Both upper part 15 and lower part 20 are made of conducting material such as copper, aluminum, or stainless steel (preferably Invar). When assembled, upper part 15 and lower part 20 form a waveguide having interior walls 30, 35, 40 and 45. Walls 30, 35 and 40 are formed from lower part 20, while wall 45 is formed from upper part 15. The rectangular cross-sectional waveguide made of walls 30, 35, 40 and 45 has a width of about 0.75 inch and a height of about 0.375 inch, in a specific embodiment where the cutoff frequency of the dominant $TE_{10}$ mode in waveguide is about 7.88 Gigahertz (GHz). The waveguide of filter 10 has flanged ends 50 with holes 55 therethrough for fasteners such as screws or bolts (not shown) so that filter 10 may be connected to other elements in a microwave (or millimeter-wave) transmission system. In the present specific embodiment, the waveguide is filled with air, but the waveguide may be filled with different materials in other embodiments.

FIG. 1(*b*) is a top perspective view of upper part 15 and lower part 20 of the unassembled evanescent mode band reject filter 10 of FIG. 1(*a*). As seen in FIG. 1(*b*), upper part 15 includes cutoff cavities 70, and lower part 20 includes tuning stubs 75 corresponding to each cutoff cavity 70. As seen in FIG. 1(*b*), upper part 15 is a substantially solid block having cutoff cavities 70 formed therein. Upper part 15 has a height (h) and a minimal width (w) sufficient to provide cutoff cavities 70 formed in the solid block. The solid block of upper part 15 extends beyond w at the sides to provide flanges having holes 80 for fasteners 25 to secure and facilitate attachment to lower part 20, which also has holes 85 correspondingly.

As seen in FIG. 1(*b*), each cavity 70 is a circular substantially cylindrical cavity having a circular cross-section and cavity walls 75 is formed in wall 45 of upper part 15. The circular cross-section of each cavity 70 has a diameter of about 13.5 millimeters (mm), which is less than the width of the waveguide of filter 10, according to the specific embodiment. Cavity walls 75 are substantially parallel to walls 30 and 40 in the specific embodiment, and provide a cavity depth of about 18 mm. Of course, the cavity depth should be less than h, which is about 20 mm in the specific embodiment. In some embodiments, cavity walls 75 may be slightly slanted inward towards the center of the corresponding cavity 70 to facilitate manufacturing of filter 10. Cavity depth, although not critical to filter performance, preferably should not be less than the diameter of cavity 70. However, cavity depth may be less than the diameter of cavity 70 in other embodiments. According to the specific embodiment, filter 10 has a length of about 140 mm to accommodate four cutoff cavities 70. In accordance with other specific embodiments, longer filters with more cavities will generally result in a wider stopband bandwidth and increased rejection over the stopband, as compared to shorter filters with fewer cavities. For other specific embodiments, each cavity 70 may have different diameters to provide a band reject filter with a wider stopband bandwidth, as compared to a filters where each cavity has the same diameter.

Each cutoff cavity 70 is separated from an adjacent cutoff cavity 70 by a distance ($d_c$ measured between respective centers of each cavity 70) of about 30 mm in the specific embodiment. As mentioned above, the location of the stopband of filter 10 advantageously is controlled by the diameter of the cavities, rather than being dependent on the oftentimes strangely-shaped dimensions of apertures used in conventional propagation mode band reject filters. Unlike conventional propagation mode band reject filters where the depth of the cavities determines the stopband frequency and the spacing between cavities controls passband VSWR, the depth of cavities 70 and the spacing between cavities 70 are not critical in evanescent mode band reject filter 10 of the present invention. In accordance with other embodiments, the band reject filter may have a different $d_c$ between different adjacent cavities.

In some embodiments of filter 10, each cavity 70 may produce some inductance which can be matched by the use of the corresponding tuning stub 75. Each tuning stub 75 is separated from an adjacent tuning stub 75 by about $d_c$, since each tuning stub 75 is located substantially at the center of its corresponding cavity 70. Because each cutoff cavity 70 and corresponding stub 75 can be matched independently of the other cavity/stub pairs, minor variations in individual filters 10 due to manufacturing tolerances do not result in filter-to-filter performance problems that are often encountered with other conventional band reject filters. It is recognized that other specific embodiments may not require the use of stub tuners. For the filters discussed above and below according to the present invention, upper and parts of the filters may be easily formed by milling cavities and/or partial waveguides with stub tuner through-holes into solid metal blocks, or by providing molded metal blocks having cavities and/or partial waveguides with stub tuner through-holes formed therein. The parts of these filters may thus be manufactured fairly easily without having to create complex apertures or manually putting together complicated structures to make high performance filters. Accordingly, manufacturing is facilitated with the present invention.

It is recognized that although the specific embodiments described above and below have specific dimensions appropriate for use in microwave transmission systems, other embodiments with different dimensions appropriate for use in millimeter-wave transmission systems are also within the scope of the invention. Further, the specific embodiments described above and below have substantially cylindrical cavities having a circular cross-section, but other embodiments of the invention may have cavities with elliptical or substantially rectangular cross-sections. It is also possible that the cavities in the same filter may have different cross-sections, depths, dimensions and other variations from each other to provide a filter having a combination of different types of cavities.

Figure 2A:
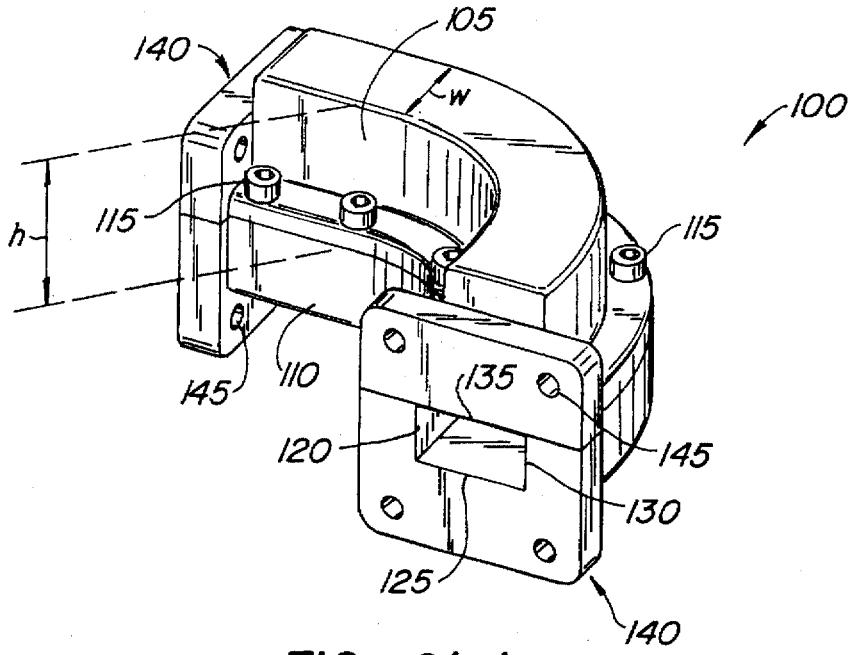
FIG. 2(*a*) is an exterior perspective view of an assembled curved evanescent mode band reject filter, according to another specific embodiment of the present invention.
Figure 2B:
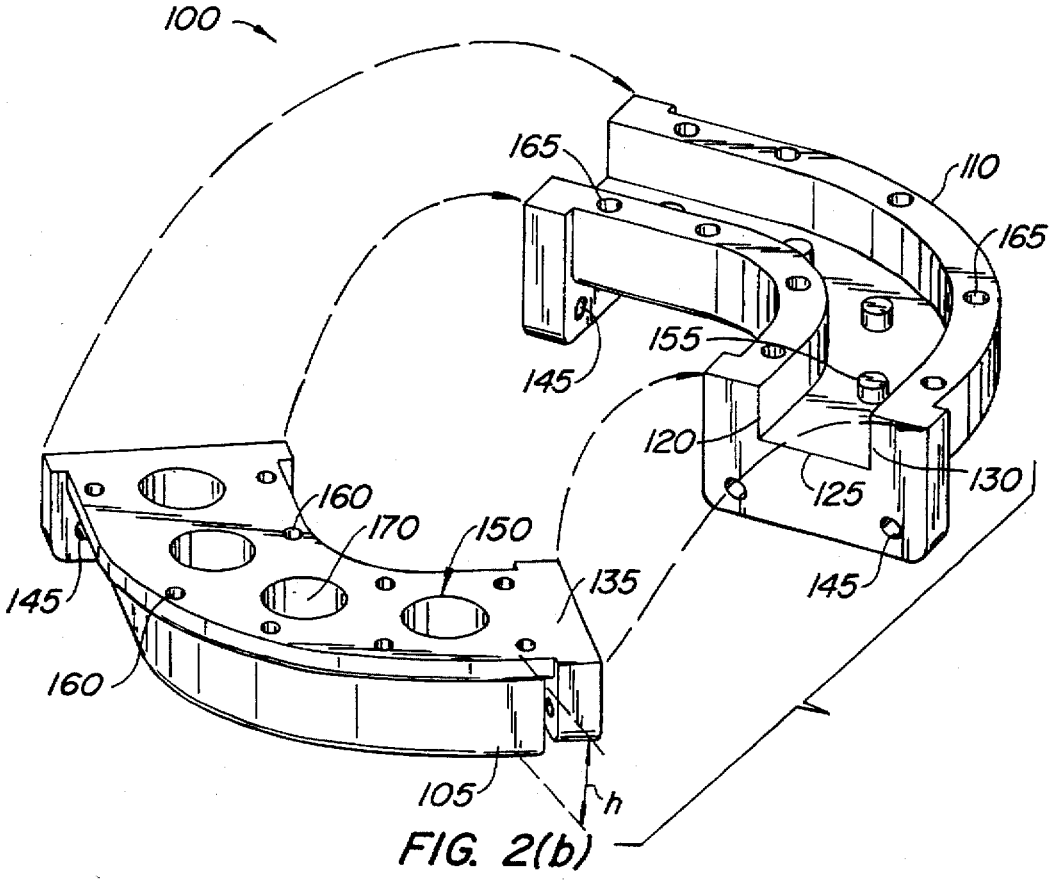

FIGS. 2(*a*) and 2(*b*) illustrate another specific embodiment, similar to the specific embodiment of FIGS.

1(*a*) and 1(*b*) except having a bend or curve instead of being straight. FIG. 2(*a*) is an exterior perspective view of an assembled curved evanescent mode band reject filter, according to another specific embodiment of the present invention. As seen in FIG. 2(*a*), assembled curved evanescent mode band reject filter 100 includes a curved upper part 105 and a curved lower part 110, which may be secured to each other by fasteners 115 such as screws or bolts going through holes (not seen in FIG. 2(*a*)) disposed through upper part 105 and lower part 110. When assembled, upper part 105 and lower part 110 form a curved waveguide having interior walls 120, 125, 130 and 135. Walls 120, 125 and 130 are formed from lower part 110, while wall 135 is formed from upper part 105. The rectangular cross-sectional waveguide made of walls 120, 125, 130 and 135 has a width of about 0.75 inch and a height of about 0.375 inch, in the specific embodiment where the cutoff frequency of the waveguide is about 7.88 GHz. Of course, for other embodiments, the waveguide dimensions will vary for different cutoff frequencies. The waveguide of filter 100 has flanged ends 140 with holes 145 therethrough for fasteners like screws or bolts (not shown) so that curved filter 100 may be connected to other elements in a microwave transmission system.

Generally, curved filter 100 is useful for connecting elements in transmission systems which have space constraints. Although curved filter 100 shown in FIGS. 2(*a*) and 2(*b*) has a specific curvature and dimensions, various other curvature types and dimensions also may be used in other embodiments.

FIG. 2(*b*) is a top perspective view of upper part 105 and lower part 110 of the unassembled curved evanescent mode band reject filter 100 of FIG. 2(*a*). As seen in FIG. 2(*b*), upper part 105 includes cutoff cavities 150, and lower part 110 includes tuning stubs 155 corresponding to each cutoff cavity 150. As seen in FIG. 2(*b*), upper part 105 is a substantially solid curved block having cutoff cavities 150 formed therein. Upper part 105 has a height (h) and a minimal width (w) sufficient to provide cutoff cavities 150 formed in the curved solid block. The curved solid block of upper part 105 extends beyond w at the sides to provide flanges having holes 160 for fasteners 115 to secure and facilitate attachment to lower part 110, which also has holes 165 correspondingly.

Filter 100 shown in FIGS. 2(*a*) and 2(*b*) have cavity dimensions similar to those discussed above for filter 10 shown in FIGS. 1(*a*) and 1(*b*), with similar advantages. In general, curved evanescent mode band reject filter 100 and straight filter 10 exhibit comparable performance. As an example of typical filter performance, FIGS. 3 and 4 are graphs illustrating performance measurements of evanescent mode band reject filter 100 from 10 GHz to 15 GHz, according to the specific embodiment in FIG. 2(*a*).

Figure 3:
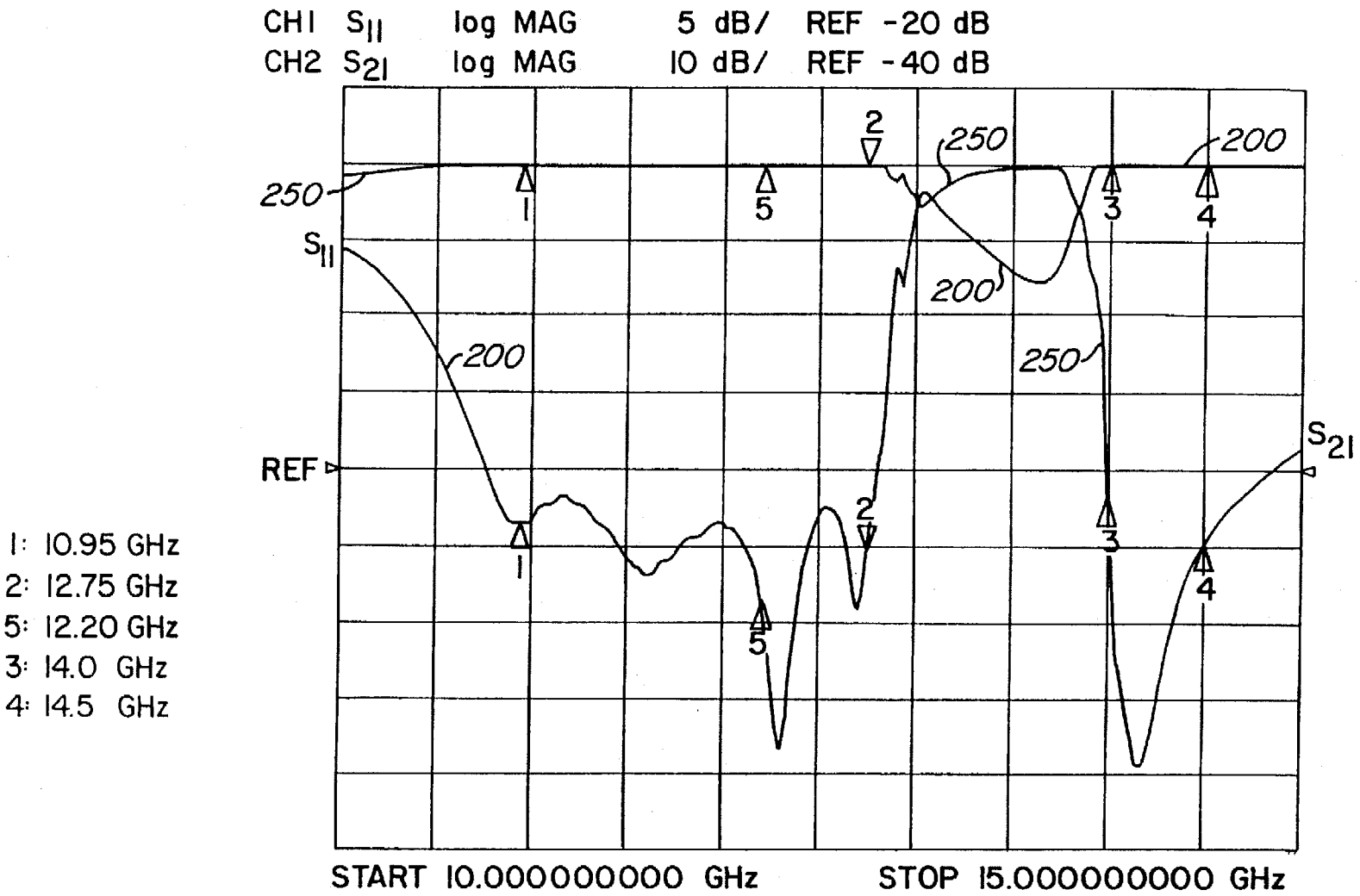
FIG. 3 is a graph showing the measured $S_{11}$ and $S_{21}$ performance of the evanescent mode band reject filter of FIG. 2(*a*), according to a specific embodiment.
Figure 4:
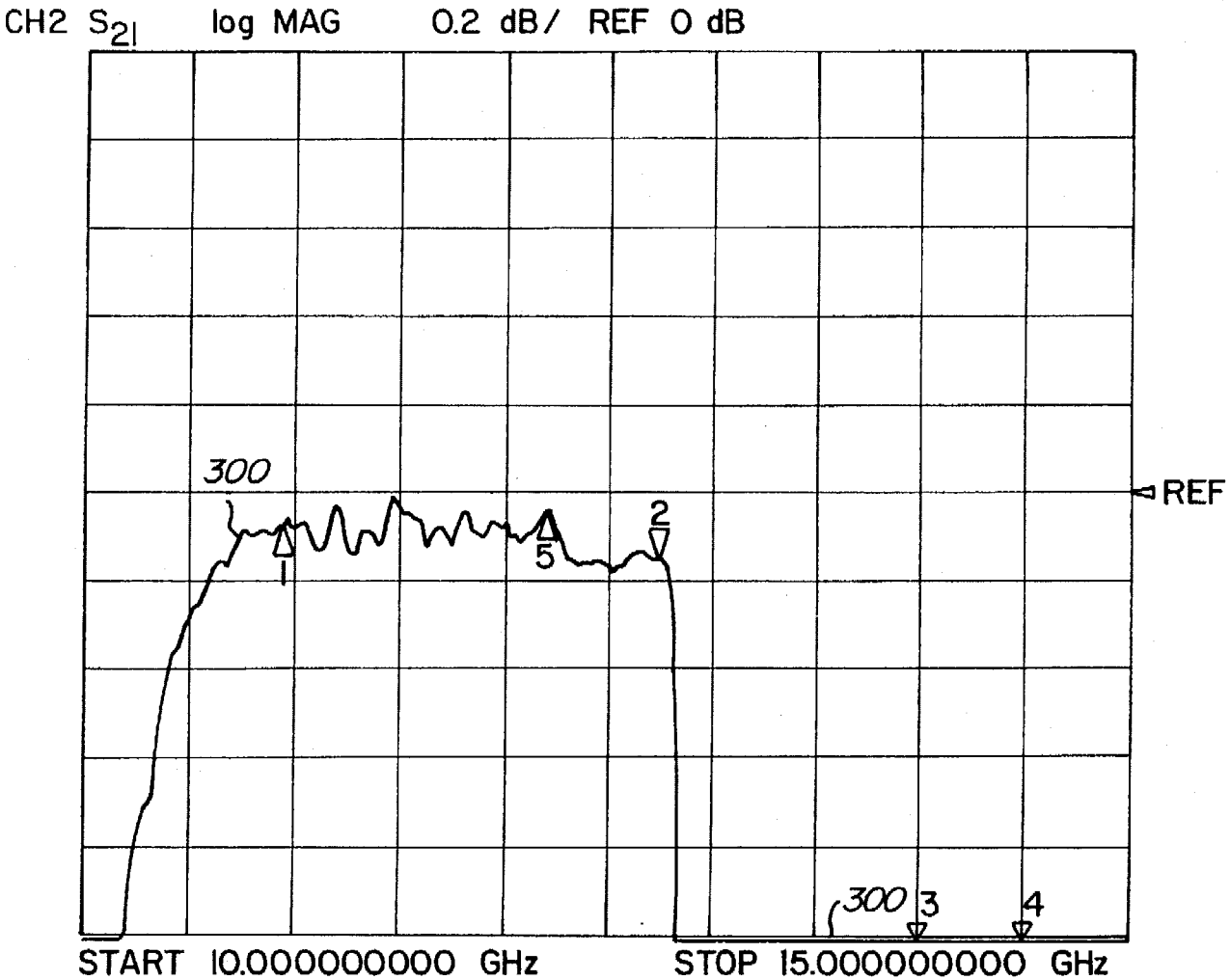
FIG. 4 is a graph showing on a magnified scale the measured $S_{21}$ performance of the evanescent mode band reject filter of FIG. 2(*a*), according to a specific embodiment.

In particular, FIG. 3 is a graph showing the measured $S_{11}$ performance and the measured $S_{21}$ performance over the measured frequency range. The return loss, $S_{11}$, which is proportional to the input VSWR, is the ratio of power reflected at the filter input to the power input to the filter input. $S_{11}$ is indicated by line 200 and is shown on a 5 decibel (dB)/unit scale with the reference at −20 dB. The transmission loss, $S_{21}$, is the ratio of power output at the filter output to the power input to the filter input. $S_{21}$ is indicated by line 250 and is shown on a 10 dB/unit scale with the reference being at −40 dB. For a high performance band reject filter, it is desirable that $S_{11}$ be low (i.e., low power reflection at the input) and $S_{21}$ be high (i.e., good transmission or low insertion loss) for passband frequencies, and that $S_{21}$ be low (i.e., good band rejection) at stopband frequencies.

As seen in FIG. 3, specific measurements of $S_{11}$ and $S_{21}$ at specific frequencies were taken, as shown in Tables 1 and 2, respectively, that indicate that filter 100 has good input VSWR and transmission performance at the passband (about 10.95 GHz to about 12.75 GHz) and excellent band rejection performance over the stopband (between about 14.0 GHz to about 14.5 GHz).

TABLE 1

Return Loss Characteristics ($S_{11}$)

| Frequency (GHz) | $S_{11}$ (dB) |
|---|---|
| 10.95 | −23.36 |
| 12.20 | −28.55 |
| 12.75 | −25.47 |

TABLE 2

Transmission Loss Characteristics ($S_{21}$)

| Frequency (GHz) | $S_{21}$ (dB) |
|---|---|
| 10.95 | −0.07 |
| 12.20 | −0.06 |
| 12.75 | −0.15 |
| 14.0 | −43.67 |
| 14.5 | −49.44 |

FIG. 4 is a graph showing the measured $S_{21}$ performance of evanescent mode band reject filter 100 of FIG. 2(*a*), according to the specific embodiment. Specifically, FIG. 4 shows the measured $S_{21}$ on a magnified scale over the measured frequency range of 10 GHz to 15 GHz in order to show the ripple across the passband of filter 100. In FIG. 4, $S_{21}$ is indicated by line 300 and is shown on 0.2 dB/unit scale with the reference being at 0 dB. For a high performance band reject filter, it is desirable that $S_{21}$ be high and have minimal ripple over the passband frequencies, in addition to $S_{21}$ being low at stopband frequencies. As seen in FIG. 4, specific measurements of $S_{21}$ at specific frequencies were taken that indicate that filter 100 has good transmission performance with minimal ripple (less than 0.2 dB) at the passband (about 10.95 GHz to about 12.75 GHz).

It is to be understood that the above description is intended to be illustrative and not restrictive. Many embodiments remaining within the scope of the claims of the present invention will be apparent to those of skill in the art upon reviewing the above description. For example, although the specific embodiment shows dimensions for a particular stopband frequencies, other embodiments will have different dimensions for other stopband frequencies. Although the specific embodiments illustrate filters at about microwave frequencies, other embodiments may be filters at millimeter-wave frequencies. In addition, although the specific embodiments have upper and bottom parts of the filters connected using fasteners like screws or bolts, other types of fastening mechanisms such as clamps, clips, epoxy, etc. also may be used in other embodiments. Further, the specific embodiments show filters using four cutoff cavities, however other embodiments may utilize fewer or more cutoff cavities for different applications. Still further, the specific embodiments illustrate cutoff cavities having a particular diameter, but other diameters may be used in other embodiments with different requirements. Still further yet, other embodiments may have a combination of cutoff cavities with varying cross-sections, depth, diameter, separation, etc. The scope of the inventions should, therefore, be determined not with reference to the above description, but should instead be determined with reference to the appended claims, along with the full scope of equivalents to which such claims are entitled.

What is claimed is:

1. A band reject filter comprising:

a waveguide having an input, an output, a first wall between said input and said output, and a second wall opposite said first wall, said first wall being part of a substantially solid first block, said second wall being part of a substantially solid second block, said waveguide capable of transmitting an electromagnetic radiation signal from said input to said output, said signal at an operating frequency above a waveguide cutoff frequency; and at least one cavity coupled directly to said first wall of said waveguide, said cavity being a substantially cylindrical cavity formed in said first block, said cavity operating in an evanescent mode such that said cavity has a cavity cutoff frequency above the stopband frequency of said band reject filter.

2. The band reject filter of claim 1 wherein said electromagnetic signal is a microwave or millimeter-wave signal, and said cavity has a cross-section that is circular, elliptical, or substantially rectangular.

3. The band reject filter of claim 1 wherein said waveguide is a rectangular cross-sectional waveguide having side walls perpendicular to said first and second walls, and said substantially cylindrical cavity has slightly inwardly slanted cavity walls substantially parallel to said side walls.

4. The band reject filter of claim 1 wherein said cavity has a circular cross-section with a diameter that determines the stopband frequency.

5. The band reject filter of claim 4 wherein said waveguide is a rectangular cross-sectional waveguide having side walls perpendicular to said first and second walls, and said substantially cylindrical cavity has cavity walls parallel to said side walls.

6. The band reject filter of claim 4 wherein said waveguide is a rectangular cross-sectional waveguide having side walls perpendicular to said first and second walls, and said substantially cylindrical cavity has slightly inwardly slanted cavity walls substantially parallel to said side walls.

7. The band reject filter of claim 4 further comprising:

at least one tuning stub disposed through said second block and said second wall and opposite said cavity for impedance matching to said cavity.

8. The band reject filter of claim 4 wherein said diameter is about 13.5 mm and said stopband frequency is about 14 GHz.

9. The band reject filter of claim 8 wherein said waveguide has a cross-sectional width of about 0.75 inch and cross-sectional length of about 0.375 inch for said waveguide cutoff frequency of about 7.88 GHz.

10. The band reject filter of claim 9 wherein said waveguide is a curved waveguide.

11. The band reject filter of claim 9 further comprising:

at least one tuning stub disposed through said second block and said second wall and opposite said cavity for impedance matching to said cavity.

12. The band reject filter of claim 4 further comprising:

a plurality of cavities formed in said first block, said plurality of cavities including said at least one cavity, and each of said plurality of cavities operating in the evanescent mode.

13. The band reject filter of claim 12 wherein at least two of said plurality of cavities have the same type of cross-section.

14. The band reject filter of claim 13 wherein said at least two of said plurality of cavities have circular cross-sections with the same diameters.

15. The band reject filter of claim 13 wherein said at least two of said plurality of cavities have circular cross-sections with different diameters.

16. The band reject filter of claim 12 further comprising:

a plurality of tuning stubs disposed through said second block and said second wall and opposite said plurality of cavities for impedance matching said cavities.

17. The band reject filter of claim 2 further comprising:

a plurality of cavities formed in said first block, said plurality of cavities including said at least one cavity, each of said plurality of cavities operating in the evanescent mode; and a plurality of tuning stubs disposed through said second block and said second wall and opposite said plurality of cavities for impedance matching said cavities.

18. The band reject filter of claim 17 wherein said at least two of said plurality of cavities are different in either cross-section type or dimension from each other.

19. The band reject filter of claim 17 wherein said waveguide is a curved waveguide.

20. A method of making an evanescent mode band reject filter comprising a waveguide coupled to a plurality of cutoff cavities, said method comprising the steps of:

providing a first block having a first surface forming a first wall of a waveguide, said first block including plurality of cutoff cavities formed therein from said first surface, said plurality of cutoff cavities directly coupled to said waveguide;

providing a second block having a second surface, a third surface and a fourth surface, said second surface to form a second wall of said waveguide, said second wall to be opposite to said first wall in said waveguide, and said third and fourth surfaces forming opposite side walls of said waveguide and to be perpendicular to said first and second walls of said waveguide; and connecting said first block and said second block together such that said second surface and said first surface face each other to form said waveguide, wherein each of said plurality of cutoff cavities operates in an evanescent mode such that said plurality of cutoff cavities have cavity cutoff frequencies above the stopband frequency of said evanescent mode band reject filter.

21. The method of claim 20 wherein said plurality of cutoff cavities are substantially cylindrical cavities with a circular, elliptical, or substantially rectangular cross-section.

22. The method of claim 21 wherein said first block providing step includes providing said first block comprising a solid metal block and forming said plurality of cutoff cavities formed therein by milling said cavities into said solid metal block.

23. The method of claim 22 further comprising the step of:

forming a plurality of holes through said second wall of said waveguide for a plurality of stub tuners to be disposed therethrough, such that each of said plurality of cutoff cavities is to be substantially opposite a corresponding one said plurality of stub tuners.

24. The method of claim 21 wherein said first block providing step includes providing a molded metal block having cavities formed therein.

25. The method of claim 24 further comprising the step of:

forming a plurality of holes through said second wall of said waveguide for a plurality of stub tuners to be disposed therethrough, such that each of said plurality of cutoff cavities is to be substantially opposite a corresponding one said plurality of stub tuners.

26. The method of claim 20 wherein said connecting step is accomplished by providing a plurality of through-holes through edges of said first block and of said second block, and using a plurality of screws or bolts through said plurality of through-holes to connect said first and second blocks together.

27. The method of claim 21 wherein at least two of said plurality of cutoff cavities have the same type of cross-section as each other.

28. The method of claim 21 wherein at least two of said plurality of cutoff cavities have a circular cross-section.

29. The method of claim 28 wherein said at least two of said plurality of cutoff cavities have the same diameter.

30. The method of claim 28 wherein said at least two of said plurality of cutoff cavities have different diameters.

31. The method of claim 21 wherein at least one of said plurality of cutoff cavities has slightly inwardly slanted walls.

* * * * *

UNITED STATES PATENT AND TRADEMARK OFFICE

CERTIFICATE OF CORRECTION

PATENT NO. : 5,739,734

DATED : April 14, 1998

INVENTOR(S) : Chen et al.

It is certified that error appears in the above-identified patent and that said Letters Patent is hereby corrected as shown below:

On title page, item [75]

Inventors: Ming Hui Chen; Song Mu Yang, both of Taipei, --Republic of-- China;

Item [73]

Assignee: Victory Industrial Corporation, --Republic of-- China.

Signed and Sealed this

Twenty-third Day of June, 1998

*Attest:*

BRUCE LEHMAN

*Attesting Officer*

*Commissioner of Patents and Trademarks*